United States Patent [19]

Fuks

[11] 4,130,284

[45] Dec. 19, 1978

[54] TRAFFIC JAM BOARD GAME

[76] Inventor: Abram Fuks, 5724 Jumilla Ave., Woodland Hills, Calif. 91364

[21] Appl. No.: 826,037

[22] Filed: Aug. 19, 1977

[51] Int. Cl.[2] ..... A63F 3/04

[52] U.S. Cl. ..... 273/248; 273/285

[58] Field of Search ..... 273/248, 249, 285

[56] References Cited

U.S. PATENT DOCUMENTS

| | | | |
|---|---|---|---|
| 1,391,333 | 9/1921 | McManus | 273/249 |
| 1,430,778 | 10/1922 | Williams | 273/285 |
| 1,469,301 | 10/1923 | Hanke et al. | 273/248 |
| 1,642,711 | 9/1927 | Alfonso | 273/249 |

FOREIGN PATENT DOCUMENTS

| | | | |
|---|---|---|---|
| 993469 | 7/1976 | Canada | 273/248 |
| 21018 of | 1912 | United Kingdom | 273/249 |
| 1436453 | 5/1976 | United Kingdom | 273/285 |

*Primary Examiner*—Anton O. Oechsle

*Attorney, Agent, or Firm*—LeBlanc & Shur

[57] ABSTRACT

A board game is disclosed whereby play advances by frustrating an opponent's progress through creating a series of intersection traffic jams on intersecting, defined pathways. The game arrangement includes a rectangular foldable board having a playing surface with printed indicia thereon, said indicia defining a centrally disposed circle with radial pathways extending from the center thereof through said circle and terminating at lateral pathways disposed adjacent opposite ends of said board and parallel thereto. Said circular, radial, and lateral pathways are segmented, and intersections thereof marked. Each player must move a total of preferably twelve shuttles across the board with movement dictated by alternate throws of a pair of dice. Players' shuttles enter the pathways at three marked points at one end of the board and must exit at a single point at the opposite end thereof. The board has upstanding sides and compartments located at either end and is centrally hinged so that said game arrangement is adapted to be self-contained when the opposing halves of said board are folded together.

7 Claims, 2 Drawing Figures

TRAFFIC JAM BOARD GAME

Figure 1:
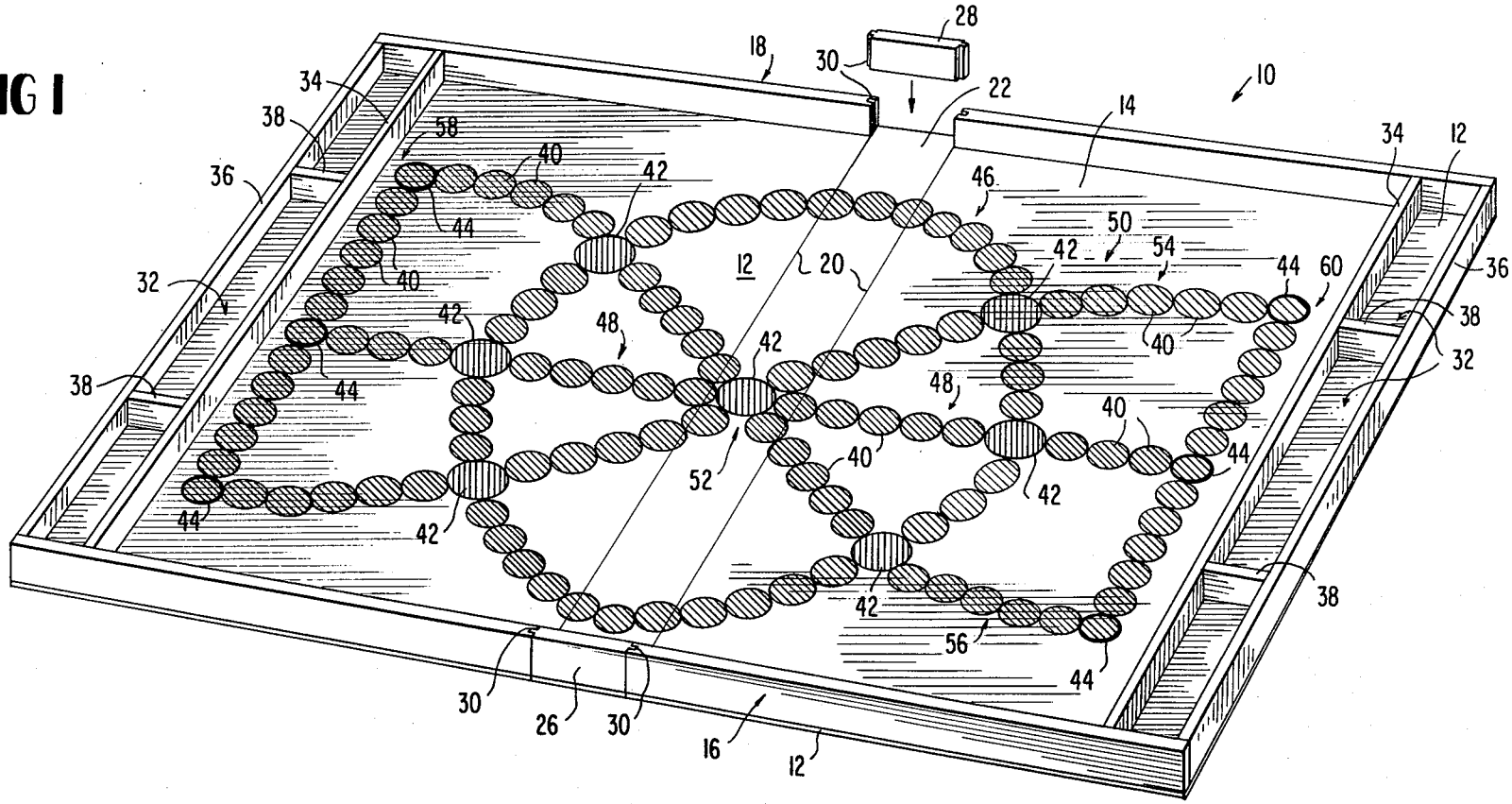

This invention relates to a board game wherein opponents attempt to move pieces across defined intersecting pathways in opposite directions. The principle of the game simulates a series of traffic jams wherein a player attempts to block intersecting pathways in order to frustrate an opponent's advance across the board. The first player completing movement of all pieces through the pathways, and across the board, wins the game.

Accordingly, this invention comprises a game which may be played by children or adults, wherein the complexity thereof depends upon the strategies used by the players. Although the advance of each player is dictated by a throw of a pair of dice, the game is susceptible to considerable skill in devising said strategies, in addition to luck.

The game board itself has lateral, spaced, hinged connections, upstanding sides, and compartments disposed at either end for containing the movable pieces used in play, and the dice for each player. In design then, the board may be folded to a self-contained, briefcase-style package when not in use.

In contrast to prior board games such as that disclosed in U.S. Pat. No. 1,270,675, play does not involve capturing opponent's pieces, or safe areas wherein pieces may not be disturbed. The instant invention, in contrast, eliminates these usual aspects of board games so that the instant invention may be easily understood and played by small children. In addition however, by providing a plurality of intersecting pathways which may be jammed to frustrate an opponent's progress, the instant invention is susceptible to a wide variety of strategies thereby complexity of the play is dictated by the players' ability rather than by construction of the board, the playing surface, or the rules thereof.

Therefore, the instant invention is readily adaptable to play by either small children or adults and is equally adaptable to either group without alteration of the rules, playing surface, or playing pieces.

Accordingly, it is an object of this invention to provide a board game which may be played by a wide variety of ages of players wherein the complexity of the play depends entirely upon the strategies devised by the players.

It is another object to provide a board game wherein the playing surface comprises a plurality of intersecting pathways and the object of the game is to move a player's pieces across the board, through one of several alternate pathways before an opponent can advance in an opposite direction therethrough.

It is still another object of this invention to provide a board game having a playing surface with segmented pathways thereon and a plurality of marked intersections which may be blocked by one player against movement therethrough by another player, and wherein movement is dictated by the throw of a pair of dice in alternate turns between players.

It is still another object to provide a board game playable by both small children and adults wherein the opposite halves thereof are interconnected by a hinged joint, the face of which is integral with the playing board, so that when the game is not in use, the opposing halves may be folded together for storage.

These and other objects will be readily apparent with reference to the drawing and following description wherein FIG. 1 is a prospective view of the game board of this invention with removable center section shown in exploded relationship to said board, and with the segmented pathways inscribed upon the surface thereon, lines for the colors red and green.

Figure 2:
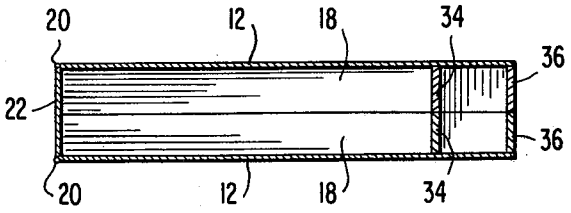

FIG. 2 is a cross-sectional view of the game board of this invention folded into a compact package for storage or transporting.

With attention to the drawings, the game board 10 of this invention includes a rectangular playing surface 12, the background 14 of which should be inscribed in a color coded fashion to highlight the player's visible impression of the board. Upstanding, longitudinally extended sides 16 and 18 are mounted on the opposing longitudinal edges of said board 12.

The board 12 includes laterally extending, hinged joints 20 which extend the width thereof and are disposed on either side of center portion 22 of said board 12. The upper surface of center portion 22, as shown in FIG. 1, is adaptable to be integral with said board when said board is open. Each of said sides 16 and 18 mount removable center sections 26 and 28 which are joined to said sides by, preferably, tongue and groove joints 30. Accordingly, when the board is opened to the playing position of FIG. 1, sides 26 and 28 prevent folding of the board. However, upon removal of sides 26 and 28, the board may be folded along joints 20 into the briefcase style package shown in FIG. 2.

A plurality of compartments 32 are formed at either end of the board 12 by spaced, upstanding endwalls 34 and 36, and dividers 38 may be disposed laterally between said endwalls to separate the space therebetween into compartments as desired. The compartments 32 may be utilized to contain shuttles and dice (not shown) utilized for play as will be subsequently explained. The shuttles preferably are circular plastic discs ¾ inch in diameter and ¼ inch thick and in the preferred embodiment of this invention, each player has one set of 12 shuttles and a pair of dice.

As shown in FIG. 1, the playing surface comprises a plurality of interconnected pathways formed of preferably green colored circles 40, and seven preferably red colored circles 42 disposed at intersections on said playing surface. Finally, three entrance and exit points are identified at either end of said board by circles 44 which are preferably colored green but surrounded by a heavy black line.

Predominate features of the unique set of intersecting pathways include a centrally disposed circle 46 of green colored circles 40 having six red circles disposed at approximately 45°, 90°, 135°, 225°, 270°, and 315° about said circumference of said circle. Said circle is bisected by a longitudinal axis path 48 extending between the 90° and 270° points on said circumference to points adjacent the inner endwalls 34. Finally, an hourglass shaped set of pathways 50 is disposed co-axially with said pathway 48 and disposed about the center 52 of said circle 46. Said hourglass 50 comprises sides 54 and 56 which extend, respectively, through the 315° and 135° points on said circle and the 225° and 45° points on said circle. The top and bottom of said hourglass 50, 58 and 60, respectively, interconnect axis 48 at its end point and the respective end points of sides 54 and 56. Sides 58 and 60 are laterally disposed at either end of said board parallel to endwalls 34.

The method of play of the game of this invention is defined by general rules as follows:

Opposing players are disposed at either end of the longitudinal board 12 behind compartments 32. Each player possess preferably twleve shuttle discs and a pair of dice (not shown). A player may enter his shuttles onto the pathways only at the three entrance points 44 directly adjacent his end compartments 32. Each player must then select a single exit point 44 from the three points 44 at the opposite end of the board. At each throw of the dice, a player may at his option enter one shuttle for the combined total shown on the dice or two shuttles for the figure shown on each of said dice. The figure on said dice corresponds to the number of circles 40 or 42 over which a shuttle may be advanced.

As play progresses, a player may only advance a shuttle toward the exit point, or laterally in the case of the base line 58 or 60 of interconnecting circles 40 which connect the entrance points 44. A shuttle may not back up.

Shuttles occupying green circles 40 may be passed, but no two shuttles may occupy the same circle 40. Shuttles occupying red circles 42 may not be passed. A Jam is therefore created when one player occupys a circle 42 with a shuttle. If all possible advances of a player's shuttles are blocked by jams created by the opponent, then the player must forfeit his turn.

The winning player is the player who successfully causes all twelve shuttles to advance from starting points through the various pathways and through the exit point before the opponent can advance his shuttles across the pathways and through the opposing exit point. No shuttle may advance through the exit point except upon a throw of the exact number of circles to be advanced by one or both of said pair of dice.

Strategy may be developed by for example occupying a red circle 42 on successive moves with successive shuttles so that an intersection is continually blocked as player shuttles move therethrough.

In a preferred version of this invention, the game board 12 is produced in sizes such as 12 inches by 16 inches; 9 inches by 12 inches; and 6 inches by 8 inches. Shuttles would be either white or blue, and the background surface 14 would be yellow to highlight the green and red colors of the circles 40 and 42, which indicia defines the pathways of the playing surface.

In summary then, this invention comprises a board game wherein the playing surface is surrounded by upstanding sidewalls and at opposite ends of the rectangular playing surface, defined compartments. Spaced hinges join opposite halves of the surface, and the portion of the longitudinal sidewalls between said hinges is removable so that said game may be folded into a compact briefcasetype package for transporting or storage.

The playing surface comprises a plurality of circles which define a large centrally disposed circle having an hourglass shape inscribed thereon concentrically, the hourglass extending longitudinally across the board with ends disposed parallel to the ends of the board. Finally, the playing surface includes a longitudinal axis pathway extending between ends of said hourglass and through the center of said hourglass and said circle. The sides of said hourglass preferably intersect the circumference of said circle at complimentary points bisected by the longitudinal axis of said hourglass so that seven intersection points are defined by said overlapping pathways. The intersection points comprise the center of said circle, and points at 45°, 90°, 135°, 225°, 270° and 315° about said circumference.

The instant invention is designed to provide a game which may be played by either children or adults whereby the complexity of the game depends upon the strategies developed by the players, and not by complicated rules. Furthermore, while the element of luck enters into the play of the game in the throw of the dice, the game predominately is a game of skill depending, as stated above, upon the strategies developed by a player to frustrate progress of the opponent's shuttles through the intersecting pathways defined on the board surface by the colored circular indicia inscribed thereon.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced herein.

What is claimed and desired to be secured by U.S. Letters Patent is:

1. A board game apparatus comprising:

a playing board, a segmented series of intersecting pathways on said board and forming a playing area, said pathways defining a centrally located circle and sides of an hourglass, the sides thereof extending through a common center and through the circumference of said circle, the ends of said hourglass defined by pathways disposed adjacent and parallel to opposite ends of said board, said pathways further defining a line bisecting said circle and said hourglass along the longitudinal axis thereof and intersecting the ends of said hourglass at the center thereof; at least one storage compartment disposed at each of opposite ends of said board; a plurality of tokens constituting playing pieces for respective players, said tokens having means for indicating ownership thereof, each token adapted to be moved in successive turns along the pathways across the playing area of said board from an entrance point to an exit point; at least one pair of dice for indicating the advance of players' tokens along the pathways at successive turns.

2. The game of claim 1 wherein the tokens are discs and each segment of said pathways is circular.

3. The game of claim 1 wherein said pathways designate entrance and exit points for tokens.

4. The game of claim 1 wherein said board is rectangular, said game further comprising upstanding sides surrounding the playing area, each of said longitudinal sides having a removable center section, said board comprising foldable sections at a pair of mutually spaced hinged joints therein, each joint equi-distantly spaced from a plane bisecting the playing area laterally so that when the center sections of the sides are removed, the foldable sections of said board may be folded together.

5. The game of claim 2 wherein intersecting points of said pathways are circular segments having diameters larger than segments of said pathways that do not intersect.

6. The game of claim 1 wherein the sides of the hourglass intersect the circumference of the circle at angles of about 45°, 135°, 225°, and 315°, respectively.

7. The game of claim 1 wherein the bisecting pathway bisects the circle at angles of 90° and 270°.

* * * * *